US011808460B2

(12) United States Patent
Milani et al.

(10) Patent No.: US 11,808,460 B2
(45) Date of Patent: Nov. 7, 2023

(54) MULTIPURPOSE VERTICAL DOMESTIC EXTRACTION HOOD

(71) Applicants: Faber S.p.A., Fabriano (IT); FABER S.p.A., Fabriano (IT)

(72) Inventors: Monica Milani, Fabriano (IT); Alessandro Donnino, Fabriano (IT)

(73) Assignee: Faber S.p.A., Fabriano (IT)

( * ) Notice: Subject to any disclaimer, the term of this patent is extended or adjusted under 35 U.S.C. 154(b) by 125 days.

(21) Appl. No.: 16/367,817

(22) Filed: Mar. 28, 2019

(65) Prior Publication Data

US 2019/0301748 A1 Oct. 3, 2019

(30) Foreign Application Priority Data

Mar. 28, 2018 (IT) ..... 102018000004052

(51) Int. Cl.

| | |
|---|---|
| ***F24C 15/20*** | (2006.01) |
| ***B08B 15/02*** | (2006.01) |
| ***F24C 7/08*** | (2006.01) |

(52) U.S. Cl.

CPC ..... *F24C 15/2021* (2013.01); *B08B 15/02* (2013.01); *F24C 7/083* (2013.01)

(58) Field of Classification Search

CPC ..... F24C 15/2021; F24C 7/083; B08B 15/02

USPC ..... 454/56

See application file for complete search history.

(56) References Cited

U.S. PATENT DOCUMENTS 3,690,245 A * 9/1972 Ferlise ..... F24C 15/2021 126/299 D
3,745,908 A * 7/1973 Mayberry ..... B08B 15/023 454/61
3,889,099 A * 6/1975 Nuss ..... F24C 15/02 219/393
4,601,279 A * 7/1986 Guerin ..... F24C 15/322 219/393

(Continued)

FOREIGN PATENT DOCUMENTS

AU 2010257658 A1 * 1/2012 ..... F24C 15/20
CN 105605639 5/2016

(Continued)

OTHER PUBLICATIONS

Database WPI, Week 201722, Mar. 8, 2017, Thomson Scientific, London, GB; AN 2017-180698, XP002786677.

*Primary Examiner* — Edelmira Bosques
*Assistant Examiner* — Frances F. Hamilton
(74) *Attorney, Agent, or Firm* — Volpe Koenig

(57) ABSTRACT

A vertical domestic extraction hood (100) for air containing vapours and fumes from a hob during food preparation includes a parallelepipedic extractor body (1) containing within it functional components to draw in the aforementioned air, with the extractor body (1) having on one side (5) an opening (7) for discharging the air drawn in and filtered and on another side (8) a different opening for extraction of the air to be filtered. A panel (12) is provided at a distance from front side (10) in front of one said front side (10) of said extractor body (1). The hood (100) includes a sensor for monitoring airborne substances that is arranged in such a way as not to be directly in contact with the extracted air and is able to detect at least one characteristic of such extracted air or the air from the environment where the hood is located.

9 Claims, 3 Drawing Sheets

(56) References Cited

U.S. PATENT DOCUMENTS 4,784,114 A * 11/1988 Muckler ..... F24C 15/20 126/299 D
4,865,010 A * 9/1989 Kett ..... F24C 15/006 126/21 R
5,611,327 A * 3/1997 Teixeira Filho ..... F24C 3/124 126/39 G
6,119,678 A * 9/2000 Marchand ..... D06F 34/34 34/88
6,621,058 B1 * 9/2003 Kim ..... H05B 6/6429 219/757
6,753,511 B2 * 6/2004 Mathews, Jr. ..... H05B 3/746 219/492
6,920,874 B1 * 7/2005 Siegel ..... F24C 15/2021 126/21 A
7,866,312 B2 * 1/2011 Erdmann ..... F24C 3/12 126/299 D
7,923,664 B2 * 4/2011 Kruempelmann .. F24C 15/2014 219/490
8,004,648 B2 * 8/2011 Dunn ..... G02F 1/133385 349/161
8,849,430 B2 * 9/2014 Elston, III ..... H04L 12/2814 700/87
10,670,278 B2 * 6/2020 Ji ..... F24C 7/082
10,945,356 B2 * 3/2021 Armstrong ..... G02F 1/133385
11,098,906 B2 * 8/2021 Heppi ..... F24C 15/2035
2005/0087184 A1 * 4/2005 Yamauchi ..... F24C 15/2042 126/299 R
2005/0224069 A1 * 10/2005 Patil ..... F24C 15/2021 126/299 D
2006/0278216 A1 * 12/2006 Gagas ..... F24C 15/2028 126/299 D
2007/0089725 A1 * 4/2007 Patarchi ..... H04N 7/186 126/24
2008/0029081 A1 * 2/2008 Gagas ..... F24C 15/2042 126/299 D
2008/0102743 A1 * 5/2008 Williams ..... F24C 15/2035 348/739
2008/0264269 A1 * 10/2008 Sterzel ..... F24C 7/08 99/331
2008/0274683 A1 * 11/2008 Burdett ..... F24F 11/46 454/61
2009/0048714 A1 * 2/2009 Hanawalt ..... F24C 15/2021 700/275
2009/0274805 A1 * 11/2009 Schonemann ..... F24C 7/08 426/233
2010/0232107 A1 * 9/2010 Dunn ..... H05K 7/20972 361/695
2012/0044217 A1 * 2/2012 Okada ..... G02F 1/133382 345/204
2012/0152227 A1 * 6/2012 Oagley ..... F24C 15/2064 126/299 D
2012/0152228 A1 * 6/2012 Oagley ..... F24C 15/2064 126/299 R
2013/0092032 A1 * 4/2013 Cafferty ..... F24C 7/08 99/325
2014/0048293 A1 * 2/2014 Luongo ..... A62C 3/006 169/65
2014/0234496 A1 8/2014 Siegel et al.
2015/0226439 A1 * 8/2015 Mikulec ..... A62C 3/006 99/337
2015/0260193 A1 * 9/2015 Armstrong ..... F24C 15/20 415/1
2015/0369491 A1 * 12/2015 Estrella ..... F24C 15/006 126/21 A
2018/0238555 A1 * 8/2018 Serabatir ..... F24C 7/082
2018/0372331 A1 * 12/2018 Serabatir ..... G02B 27/0006
2019/0114935 A1 * 4/2019 Nolan ..... F24C 15/2064
2019/0154267 A1 * 5/2019 Garces ..... F24C 3/124
2019/0390858 A1 * 12/2019 Chu ..... F24C 15/2021
2020/0041139 A1 * 2/2020 Armstrong ..... F24C 15/2021
2020/0041143 A1 * 2/2020 Froelicher ..... F24C 15/20
2020/0041346 A1 * 2/2020 Funk ..... G01J 5/0044

FOREIGN PATENT DOCUMENTS

CN 106482186 3/2017
DE 102010063860 6/2012
DE 102011082925 3/2013
EP 1107647 A2 * 6/2001 ..... F24C 7/083
EP 3228941 A1 * 10/2017 ..... F24C 15/20
EP 3228941 11/2017
KR 1020110087928 A * 8/2011 ..... F24F 7/08
WO 2005052453 6/2005
WO 2014152760 9/2014
WO WO-2015057073 A1 * 4/2015 ..... B08B 15/02

* cited by examiner

MULTIPURPOSE VERTICAL DOMESTIC EXTRACTION HOOD

INCORPORATION BY REFERENCE

The following documents are incorporated herein by reference as if fully set forth: Italian Patent Application No. 102018000004052, filed Mar. 28, 2019.

BACKGROUND

The present invention relates to a vertical domestic extraction hood.

As is well known, there are different types of extractor hoods for residential kitchens and the present invention relates to a specific type of hood commonly defined as "vertical". A hood of this type is described for example in EP 3 228 941, in the name of the same Applicant.

The essential feature of a vertical hood is to ensure correct and efficient extraction performance, while maintaining a small footprint in the depth direction. Typically, in fact, the vertical hood is made up of a functional body containing a known extractor unit to which a panel or completely flat surface having an axis perpendicular to the wall with which the hood is associated is mechanically connected. This surface defines the front and perimetral air capture zones of the hood.

This surface is the area most exposed to interaction with the user, so much so that, normally, a user interface with the usual controls typical for the functions of an extractor hood, such as setting the speed of the motor of the extraction unit or turning the usual light sources associated with the hood on and off, is placed in a frontal position on the panel.

The panel is placed in front of one front face or side of the functional body or extractor body.

In general, in recent years extractor hoods have increasingly seen the incorporation of new functions to improve general comfort and performance during the food preparation process. One of the most well-known is that of providing a functional connection between the extractor hood and the hob (in the case of induction hobs) to automatically activate the extractor hood according to the number of active elements and the specific heating power used.

This solution has its limits however, because a "rigid", i.e. direct, wired or wireless connection, has to be established between the hood and the hob, which will be linked to a precise communication protocol.

In addition, the hood/hob assembly works on the assumption that when more electrical power is used on the hob there is more need to draw up unpleasant odours generated by the cooking process. This is not always true however, as there are cooking processes that take place even on low heating power but which still generate smells for which it would be necessary to use more extraction power. The known solution may not therefore be able to act effectively to draw fumes and/or vapours from the hob when these low-power cooking processes are carried out on it.

Moreover, the advent of new technologies related to the connectivity and usability of web-based multimedia content is increasingly leading to the incorporation of systems connected to the internet, cloud computing services, as well as generic multimedia content, into all household appliances. However, physical, mechanical and electrical/electronic incorporation of the devices needed to ensure these services with the "conventional" functional part of the hood is not without difficulties and problems. One solution, in fact, as described in WO2005/052453 in the name of the same Applicant, provides for the physical incorporation of several devices including monitors, interface systems and connectivity systems that constitute a complex architecture which is difficult to maintain as well as difficult to manage from the point of view of component obsolescence.

SUMMARY

The object of the present invention is to provide a vertical hood that overcomes the above limitations present in the solutions in the known art.

In particular, the object of the invention is to provide a vertical hood that incorporates new features that improve performance and comfort during the process of food preparation and cooking.

Another object of the invention is to provide a vertical hood equipped with a front panel and incorporating all the control, interface and use functions for every connectivity and external (internet) or internal multimedia service in the home environment while reducing or simplifying the architecture of the hood.

A further object of the present invention is to provide a hood of the type indicated above whose suction unit can operate automatically according to the actual production conditions of the volatile organic substances from the hob that contribute to forming the odours related to the cooking process without the need to have rigid communication, based on a fixed protocol, between the hob and the hood.

Another object is to provide a hood of the type mentioned in which the automatic extraction function can be performed by the hood regardless of the type of hob, which also comprises the possibility of working in combination with not only induction or electric, but also gas hobs.

Another object is to provide a hood of the type mentioned that also makes it possible to monitor the quality of the air in the environment or kitchen in general, in order to monitor the presence of certain pollutants, measure temperature and humidity and consequently operate the hood in "air treatment" mode even when the process of food preparation is not in progress.

A further object is to provide an extractor hood of the type mentioned above that also enables the actual condition of typical cooking processes such as boiling water or frying or adding alcohol to be monitored, and also identifies undesirable cooking situations such as the burning of fatty substances, as well as the type of source of heat production used by the hob (if a gas or induction hob).

A further object of the invention is to provide a hood of the mentioned type that "communicates" with the hob so that it can automatically modulate the heating power of the individual heating elements of such hob in a closed loop to keep the entire food cooking process under control.

A further object of the invention is to provide an extractor hood that can also be controlled in voice mode.

These and other objects that will be clear to those skilled in the art are achieved through a vertical domestic extraction hood according to the principal claim.

BRIEF DESCRIPTION OF THE DRAWINGS

For a better understanding of the present invention there are attached purely by way of non-limiting example the following drawings, in which.

DETAILED DESCRIPTION

Figure 1:
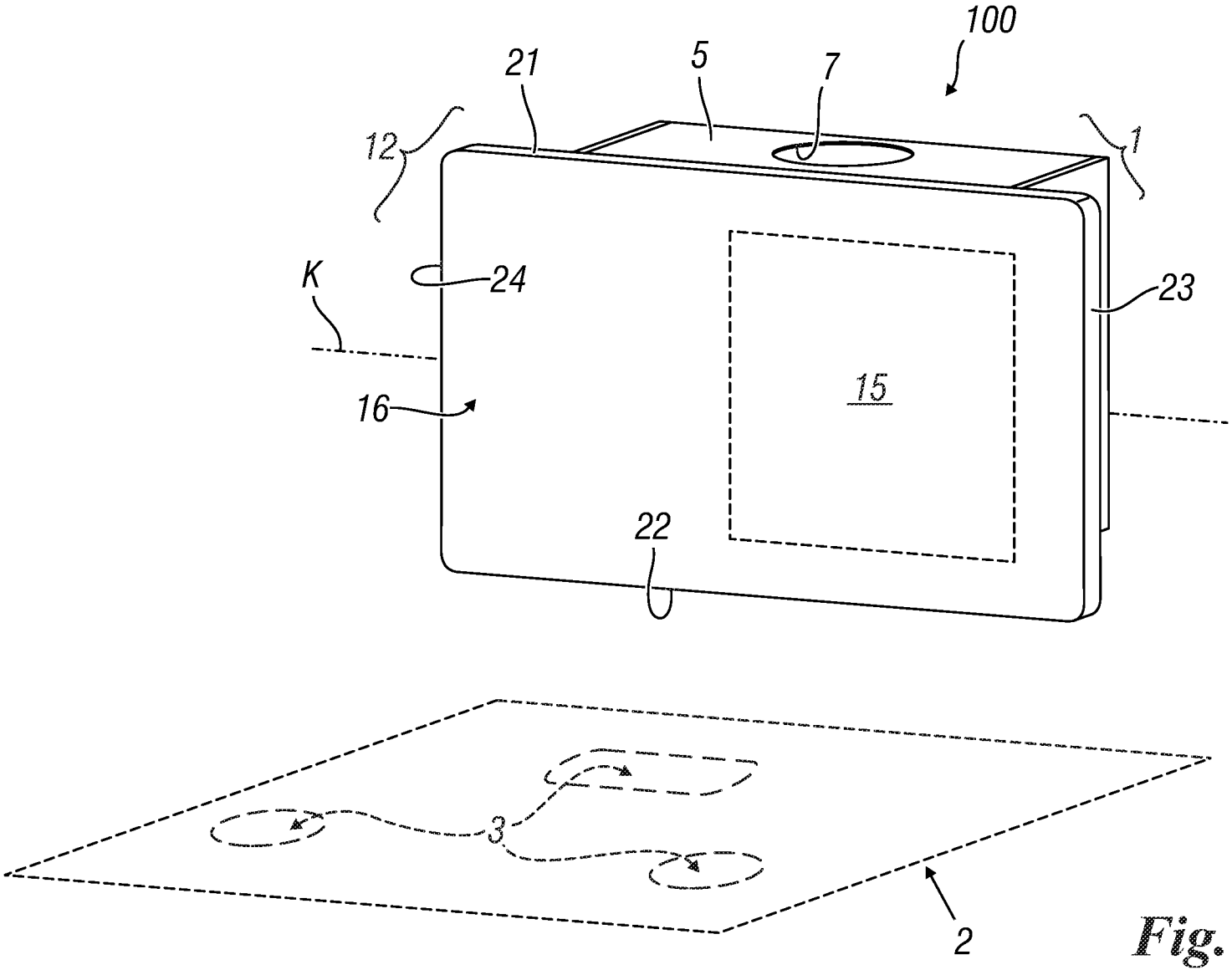
FIG. 1 shows a front perspective view of a hood according to the invention.

With reference to the above figures, a vertical hood 100 according to the invention comprises a parallelepipedic extractor body 1 containing the usual and well-known functional components (such as the fan, one or more filters, etc.) designed to draw air from a hob 2 (shown by way of example), said air containing fumes and/or vapours generated by the preparation of food placed in corresponding containers (not shown) on the heating elements 3 of such hob 2.

These heating elements may be of any type, such as gas, electric or induction.

On one side 5 (the upper in the figures), body 1 of the hood has an opening 7 to evacuate the air drawn in and filtered. This opening 7 can release air directly into the environment or the kitchen where the hood is located or be connected to pipes and/or ducts that transfer this extracted and filtered air to an outlet outside the environment.

In addition, extractor body 1 has an opening for the entry of air drawn into the body itself on at least one other side, usually lower side 8.

On front side 10 of extractor body 1 there is a panel 12 which, in a preferred embodiment of the invention, is of a multipurpose type: it has a touch screen 15 that occupies at least a portion (or even all) of a front side 16 of panel 12 (facing the user); this screen 15 at least serves as the interface with the user who commands and controls the operation of hood 1 through this screen. This control may also be provided in voice mode through the usual electrical components associated with the panel. Through this screen the user may also take advantage of advanced services such as viewing media content, web services or the air monitoring function that will be described below.

The body 1 is connected to the panel 12 in any known way (by electrical cable or data communication, wireless, Bluetooth, or the like), just as the panel 12 is connected to the internet (for example, via wi-fi connection so as to benefit from all web and cloud services) in any known way.

Figure 2:
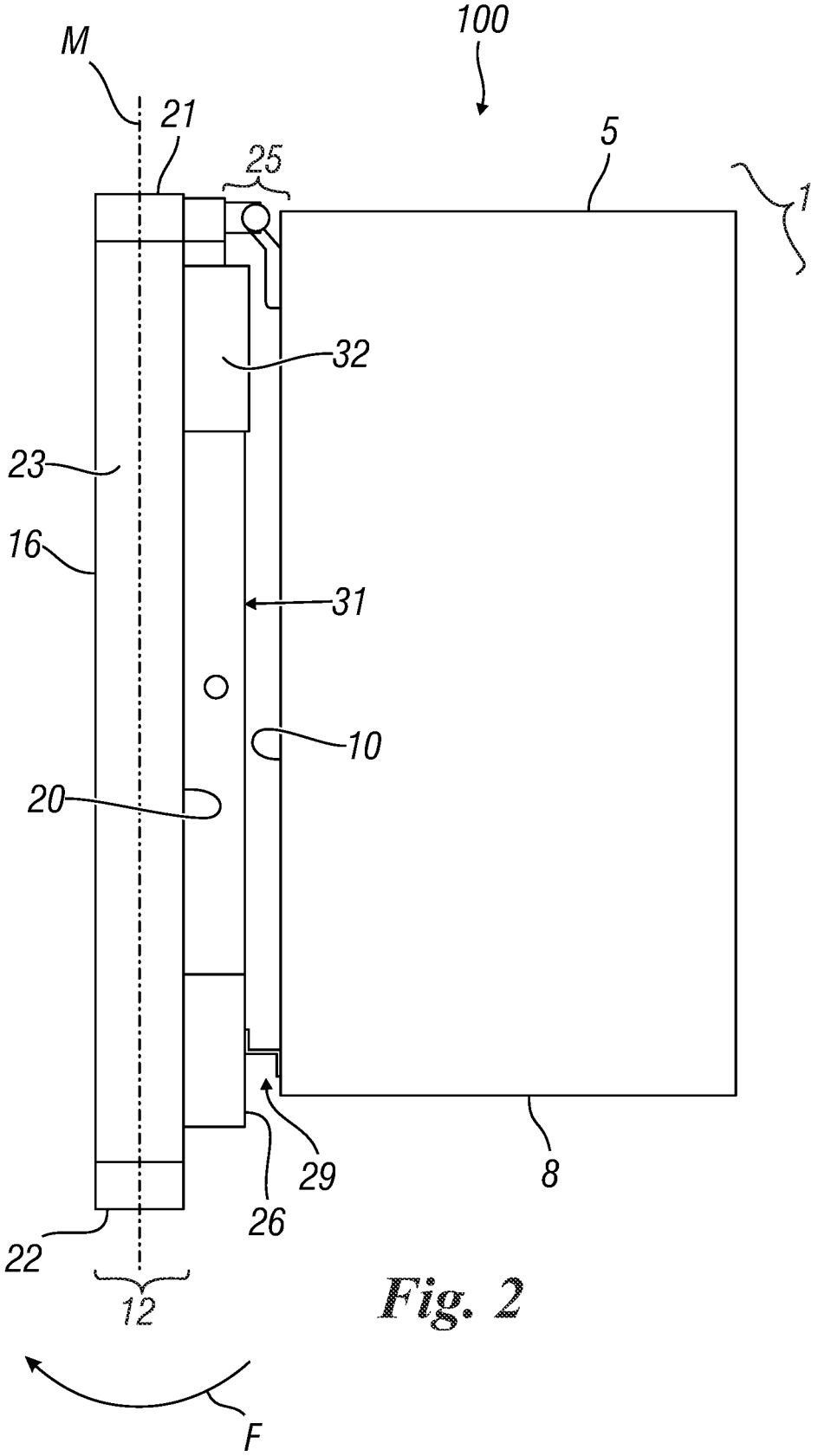
FIG. 2 shows a side view of the hood in FIG. 1.

The extractor body 1 and the panel 12 are mechanically independent of each other, but are linked together while allowing rotary movement of the panel (arrow F in FIG. 2) with an axis of rotation K perpendicular to a median axis M of such panel.

More specifically, the panel 12 comprises a rear side 20 (opposite front side 16), an upper side 21, a lower side 22 (facing hob 2), and opposite lateral sides 23 and 24. Near the upper side 21, the rear side 20 of panel 12 is associated with at least one hinge 25 (preferably at least two, see FIG. 3), also fixed to the front side 10 of extractor body 1, each hinge permitting the rotation described above. Advantageously this may be assisted by a hydraulic piston (not shown) with the ends hinged to the sides 10 and 20 respectively of the body 1 and the panel 12. Other actuators of such rotation, also remotely controlled, motor-driven or manually activated, may of course be provided.

A spacer 26, close to the lower side 22 and associated with the rear side 20 of the panel 12, ensures that the extractor body 1 and said panel are correctly parallel to each other, while maintaining a gap or space 29 between them. A secondary extraction area towards the extractor body 1 (containing the extraction unit) is thus defined by this gap along the entire perimeter of panel 12.

From the rear side 20 of the panel 12 there projects a box element 31 delimiting a space for locating the usual electrical or electronic elements that allow multipurpose operation of the panel 12, all of the hood 100 from the extraction point of view, as well as elements that enable the panel 12 to be connected to the internet or to a possible home network to which other appliances or other household facilities are connected.

A cover element 32 is then placed between the box element 31 and the hinges.

Figure 3:
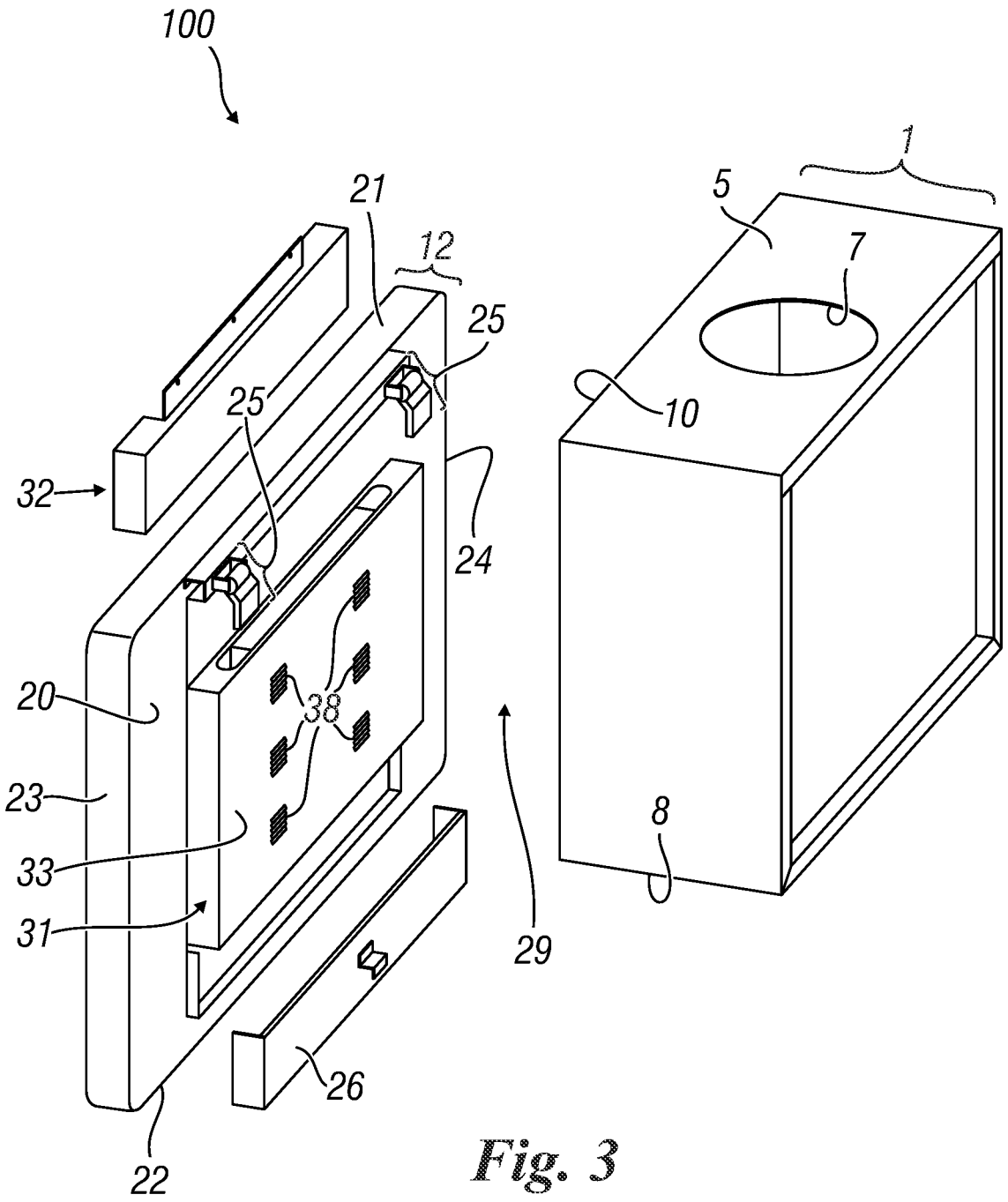
FIG. 3 shows an exploded perspective side view of the hood in FIG. 1.

As may be seen in FIG. 3, within a free flat face 33 of the box element 31 (facing the gap 29) there are one or more air-capture grilles 38 at one of which, within the element 31, there is placed a sensor for monitoring airborne substances, of a type which is in itself known and not shown. The location is specifically chosen to make the sensor interact only with the air drawn in around the perimeter so that the sensor itself is not in contact with the direct extraction flow that normally passes through the filtering area located in the lower part of the (extractor) body 1. This location makes the sensor readings more reliable over time as it is not directly in contact with the fatty substances and oils in the extracted air which might cause the sensor itself to deteriorate.

Obviously, several monitoring sensors may be provided at the corresponding grilles.

Each sensor is connected to a control unit of the extractor hood (not shown).

Each sensor is able to monitor different categories of substances in the air such as: VOC (volatile organic compounds), CO, $CO_2$, NOR, $CH_4$ and solid particles. It is also able to monitor environmental parameters such as temperature and relative humidity.

Such a sensor provides an overall air quality index that takes into account all the measurable parameters by assigning a specific weighting to the various pollutants and also averaging its value with respect to comfort parameters such as temperature and humidity.

Even when the hood is not in use for the specific object of extracting the vapours and smells generated by the cooking process, each sensor monitoring airborne substances is able to monitor the quality of the ambient air (that is, of the kitchen) and if placed in "auto" mode is able to activate automatically when particular pollutant thresholds that bring the overall index below ideal values are exceeded.

The (microprocessor) control unit associated with each sensor or, alternatively, each sensor (if equipped with its own microprocessor unit) is able to aggregate the various substances monitored into specific recognition "patterns" for the cooking process, such as the curve for boiling water or frying with oil, and also recognises appropriate cooking thresholds avoiding the typical burning of food or over-high frying temperatures. This high sensitivity ensures that the hood functions automatically according to the actual amount of "smells" that are being generated, consequently adjusting the correct extraction capacity, regardless of the type of hob that is being used, and not requiring a connection of any kind between hob and hood.

However, as an additional feature, when the hob and hood are connected the hood can automatically generate a feedback signal to a standard hob control unit on the basis of the recognised cooking patterns, to adjust the heating performance of each active heating element and prevent unsuitable cooking processes such as overheating when frying that generates undesirable substances or typical burning, as well as, for example, indicating that the boiling threshold has been reached.

Thanks to this invention, a vertical extractor hood for domestic use is provided, is improved with respect to known hoods and is capable of controlling the air drawn in and/or the air in the environment in which it is placed, which, among other things, can also permit possible control of the residual filtering capacity level of the filter or filters of the hood itself, evaluated according to analysis of the air drawn in made after such a clean filter or filters has/have been inserted into extractor body 1 of the hood.

Also, as mentioned, thanks to the invention it is possible to monitor food preparation on the hob and also act to control the heating elements of the hob itself without the need for special physical connections between the hood and the hob. Control can be applied regardless of whether these components are electric or gas (burners); in the latter case it is possible to act on the usual solenoid valve located on the gas pipe supplying the burners to reduce the heating power (flame) delivered.

The invention comprises components (body 1 and panel 12) that are interconnected, but mechanically independent of each other; in this way one or all of the parts of each of these components can be independently maintained and replaced, if necessary.

A preferred embodiment of the invention has been described. However in a simplified embodiment the panel 12 may not have a touch screen, but may still be equipped with one or more sensors for monitoring airborne substances. Also the connection with the hob is an option which an embodiment of the invention may lack.

Finally, the sensors monitoring airborne substances may be placed in any position on the panel 12 or in the body 1 (obviously so as to be able to detect the air) as long as they are not placed in a position (as for example on the side 8 of the body 1 or side 22 of panel 12) where they are directly exposed to the flow of air drawn in. This is because of the reasons described above (reliability of detection and to prevent deterioration of all the sensors).

These variants of the invention also fall within the scope of the invention as defined by the following claims.

The invention claimed is:

1. A vertical domestic extraction hood (100) for extracting air containing vapours and fumes coming from a hob (2) during food preparation, said hood comprising:

a parallelepipedic extractor body (1) containing functional components therein for drawing in air, said extractor body (1) having an opening (7) on one side (5) to discharge air drawn in and filtered and on another side (8) a different opening for drawing in the air to be filtered;

a panel (12) at a front of a front side (10) of the extractor body (1), the panel (12) having a rear side that faces and is spaced apart by a distance from said front side (10) of the extractor body (1) so as to form a space (29) between said extractor body (1) and said panel (12); and a sensor configured for monitoring airborne substances in the air in the space (29), the sensor arranged between the panel (12) and the extractor body (1) so as not to be directly in contact with the air drawn in the extractor body (1) and able to detect at least one characteristic of air from an environment where the hood is located;

wherein the sensor is located within a box element (31) of the panel (12) present on a rear side (20) thereof facing the extractor body (1), said sensor being located behind a respective grille (38) provided on a free flat face (33) of the box element (31) facing the extractor body (1), and said grill (38) is located between said sensor and the extractor body (1).

2. The hood according to claim 1, wherein the sensor is associated with at least one of said panel or said extractor body (1) in a position facing the space.

3. The hood according to claim 2, wherein the sensor is associated with at least one of the panel (12) or the extractor body (1) on a side that does not face the hob (2).

4. The hood according to claim 1, further comprising at least one of:

said sensor for airborne substances is adapted to monitor one or more of the following substances present in the air: VOC, CO, $CO_2$, $NOR_X$, $CH_4$; or said sensor for airborne substances is adapted to monitor parameters of the environment in which the hood (100) is located, including at least one of a temperature or a humidity of that environment.

5. The hood according to claim 1, further comprising a screen (15) on a front side (16) of the panel (12), the screen (15) is configured as a user interface for use of the hood (100), and a command and control unit of the hood (100) connected to said panel and to said screen (15) and being adapted to generate media content on said screen (15), said command and control unit being connectable to at least one of the internet or to a home communication network so as to be able to communicate with other appliances connected to a same network.

6. The hood according to claim 5, wherein the command and control unit is connected to a control unit for the hob (2) and is adapted to control power generated by each heating element (3) of the hob (2) according to detected characteristics of the air monitored, and said control of the power enabling the cooking process for a food placed on such hob over said heating element to be controlled.

7. The hood according to claim 1, wherein the functional components of the extractor body (1) designed to draw in air are operated according to characteristics of the air detected by the sensor.

8. The hood according to claim 1, wherein said extractor body (1) and said panel (12) are independent of each other, said panel (12) being fixed by hinges (25) to said body (1) so as to rotate with respect to the body about said hinges.

9. An assembly comprising the vertical domestic extraction hood (100) according to claim 1 and the hob (2) having a number of heating elements (3), said vertical domestic extraction hood (1) comprising the sensor for monitoring airborne substances and a control unit to which said sensor is connected, said control unit is also configured to control an operation of said heating elements of the hob according to the monitoring of airborne substances performed by said sensor.

* * * * *